US011638990B2

(12) United States Patent
Dreyer

(10) Patent No.: US 11,638,990 B2
(45) Date of Patent: May 2, 2023

(54) CARPET TACK STRIP REMOVAL TOOL

(71) Applicant: Mike Dreyer, Fargo, ND (US)

(72) Inventor: Mike Dreyer, Fargo, ND (US)

( * ) Notice: Subject to any disclaimer, the term of this patent is extended or adjusted under 35 U.S.C. 154(b) by 332 days.

(21) Appl. No.: 17/014,173

(22) Filed: Sep. 8, 2020

(65) Prior Publication Data

US 2021/0129306 A1 May 6, 2021

Related U.S. Application Data

(60) Provisional application No. 62/930,038, filed on Nov. 4, 2019.

(51) Int. Cl.
*B25C 11/00* (2006.01)
*E04G 23/00* (2006.01)
*B25G 1/08* (2006.01)

(52) U.S. Cl.
CPC ..... *B25C 11/00* (2013.01); *B25G 1/08* (2013.01); *E04G 23/006* (2013.01)

(58) Field of Classification Search
CPC ..... B25C 11/00; B25G 1/08; E04G 23/006
See application file for complete search history.

(56) References Cited

U.S. PATENT DOCUMENTS

2002/0134971 A1* 9/2002 Christensen ..... B66F 15/00 254/25
2007/0252117 A1* 11/2007 Harpell ..... B25C 11/00 254/1
2010/0237301 A1* 9/2010 Eric ..... B66F 15/00 254/25

* cited by examiner

*Primary Examiner* — Nirvana Deonauth
(74) *Attorney, Agent, or Firm* — Argus Intellectual Enterprise; Jordan Sworen; Daniel Enea

(57) ABSTRACT

A carpet tack strip removal tool. The carpet tack strip removal tool provides a device for lifting carpet tack strips from a floor surface while remaining allowing a user to remain in a standing position. The carpet tack strip removal tool includes an elongated shaft having a head at an end. The head includes a pry bar arm for placing between the flooring surface and the tack strip to be lifted, and a fulcrum lever for providing mechanical advantage when a lifting force is applied to a lifting arm. When moved from a setup position to the lifting position, the pry bar arm lifts and removed the carpet tack strip from the floor surface.

16 Claims, 5 Drawing Sheets

CARPET TACK STRIP REMOVAL TOOL

CROSS REFERENCE TO RELATED APPLICATION

This application claims the benefit of U.S. Provisional Application No. 62/930,038 filed on Nov. 4, 2019; the above identified patent application is herein incorporated by reference in its entirety.

BACKGROUND OF THE INVENTION

The present invention relates to carpet tack strip removal tools. The present invention provides a carpet tack strip removal tool having a lifting arm, a pry bar arm, and fulcrum lever for operation by a user in a standing position.

Removing tack strip strips from flooring can be labor intensive and requires the use of specific tools, such as a conventional pry bar and a hammer. Unfortunately, the use of these tools requires a person removing the tack strip to spend an extending period of time on his or her hands and knees, prying the tack strip away from the flooring. This can lead to back strain and unforeseen injuries or wasted time spent taking breaks while removing tack strips. Therefore, there exists a need for a tool that provides better ergonomics by allowing a user to stand while removing tacks and tack strips, thereby preventing undue strain to the user's body.

The present invention relates to a carpet tack strip removal tool and more particularly pertains to a new system for removing carpet tack strips that allows the user to perform the task while standing.

The present invention provides a carpet tack strip removal tool that includes a fulcrum lever that is configured for activating the removal tool when a lifting force is applied to the lifting arm, and/or alternatively when the user presses down on the fulcrum lever with the user's foot. Additionally, pressing on the fulcrum lever activates the pry bar member and removes carpet tack strips. This invention conserves the health of the user while allowing for efficient carpet tack strip removal.

In light of the devices disclosed in the known art, it is submitted that the present invention substantially diverges in design elements and methods from the known art and consequently it is clear that there is a need in the art for an improvement for a carpet tack strip removal tool. In this regard the instant invention substantially fulfills these needs.

SUMMARY OF THE INVENTION

In view of the foregoing disadvantages inherent in the known types of carpet tack strip removal tools now present in the known art, the present invention provides a new carpet tack strip removal tool wherein the same can be used in a standing position to lift a desired carpet tack strip from a floor surface by transitioning from a setup position to a lifting position by applying a lifting force to the lifting arm It is an object of the present invention to provide a carpet tack strip removal tool comprising a shaft having a lifting arm at a first end and a head at a second end; the head includes a pry bar arm at a first side and a fulcrum lever at a second side of the head, wherein the pry bar arm and the fulcrum lever are disposed on opposing sides of the shaft; wherein the pry bar arm and the fulcrum lever are aligned along a same vertical plane; a proximal end of the fulcrum lever extends from a distalmost end of the second end of the shaft and the fulcrum lever curves toward the shaft; wherein the carpet tack strip removal tool is adapted to lift a tack strip by a user in a standing position by transitioning between a setup position to a lifting position; wherein the setup position, the pry bar arm is positioned under the tack strip to be lifted from the floor surface; wherein the lifting position, the lifting arm and the fulcrum lever are operated to move towards the floor surface thereby lifting the pry bar arm and the object from the floor surface.

It is another object of the present invention to provide a carpet tack strip removal tool that allows for standing operation thereof, while providing maximum lifting efficiency when a lifting force is applied to the carpet tack strip removal tool.

It is yet another object of the present invention is to provide a carpet tack strip removal tool having a second pry bar member that is removable from the lifting arm. The second pry bar member includes a fulcrum point intermediate a handle and a second pry bar member, wherein the second pry bar member includes V-shaped notch at the tip adapted to remove nails from a floor surface.

It is another object of the present invention to provide a method of removing a carpet tack strip comprising providing the carpet tack strip removal tool; positioned the pry bar arm between a floor surface and the carpet tack strip in the setup position; and standing and applying a lifting force to the lifting arm causing the carpet tack strip removal tool to transition to the lifting position such that the fulcrum lever acts as a fulcrum point to lift the pry bar arm and the carpet tack strip from the floor surface.

It is therefore an object of the present invention to provide a new and improved carpet tack strip removal tool that has all of the advantages of the known art and none of the disadvantages.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
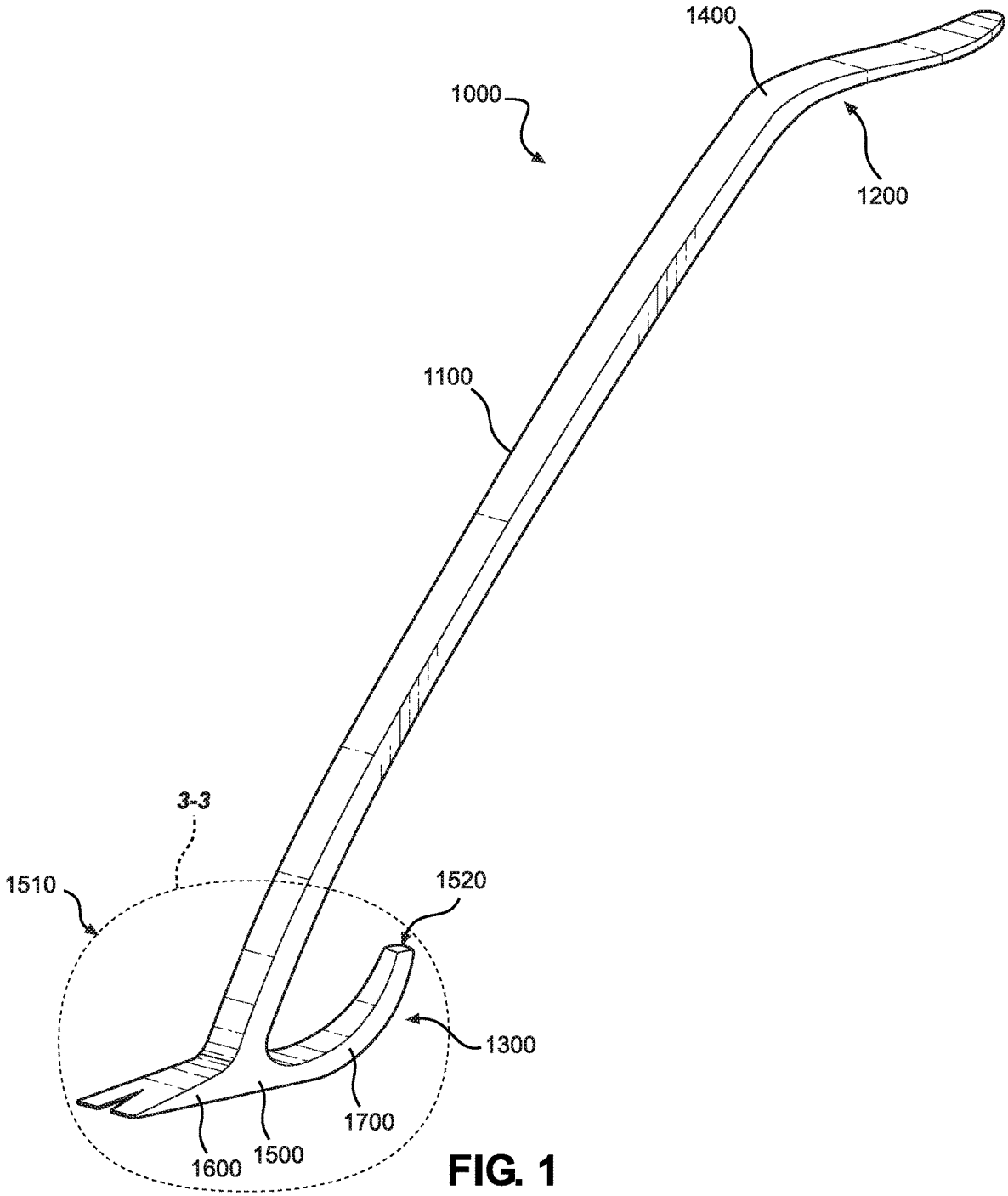
FIG. 1 shows a perspective view of one embodiment of the carpet tack strip removal tool.

Reference is made herein to the attached drawings. Like reference numerals are used throughout the drawings to depict like or similar elements of the carpet tack strip removal tool. For the purposes of presenting a brief and clear description of the present invention, the preferred embodiment will be discussed as used for removing a tack strip from a floor surface, wherein the tack strip is a plate that is secured to the floor surface via fasteners and includes upright tacks adapted to engage a carpet thereatop. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment", "first embodiment", "second embodiment", or "third embodiment" does not necessarily refer to the same embodiment.

References to "tack strip" or "tack strips" includes, and is not limited to "tack strips", "tacks", "carpet nails", "staples", and the like. Moreover, references to "floor", "floor surfaces", and the like generally refer to surfaces having flat horizontal dimensions, including vertical walls and roofs.

Figure 2:
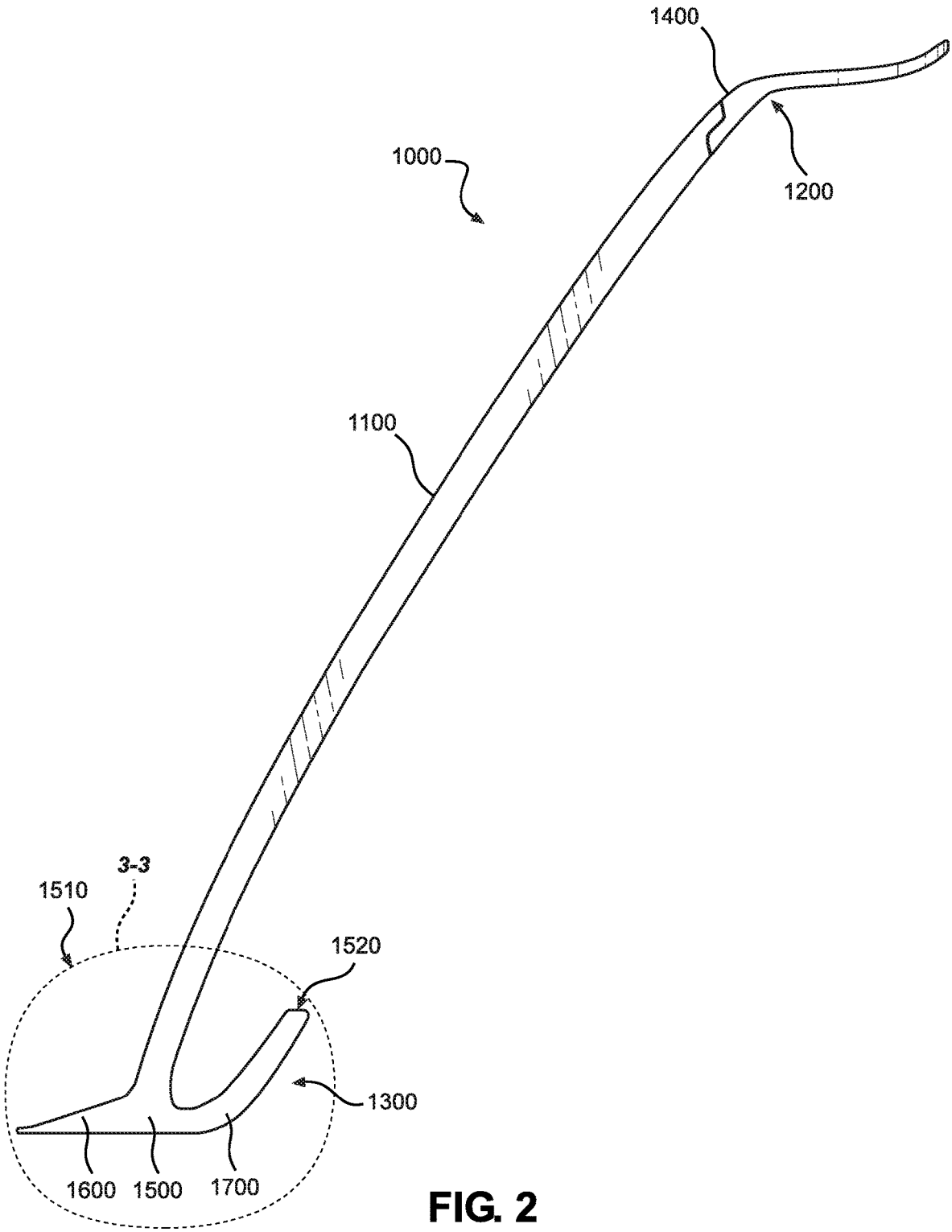
FIG. 2 shows a side view of one embodiment of the carpet tack strip removal tool.
Figure 6:
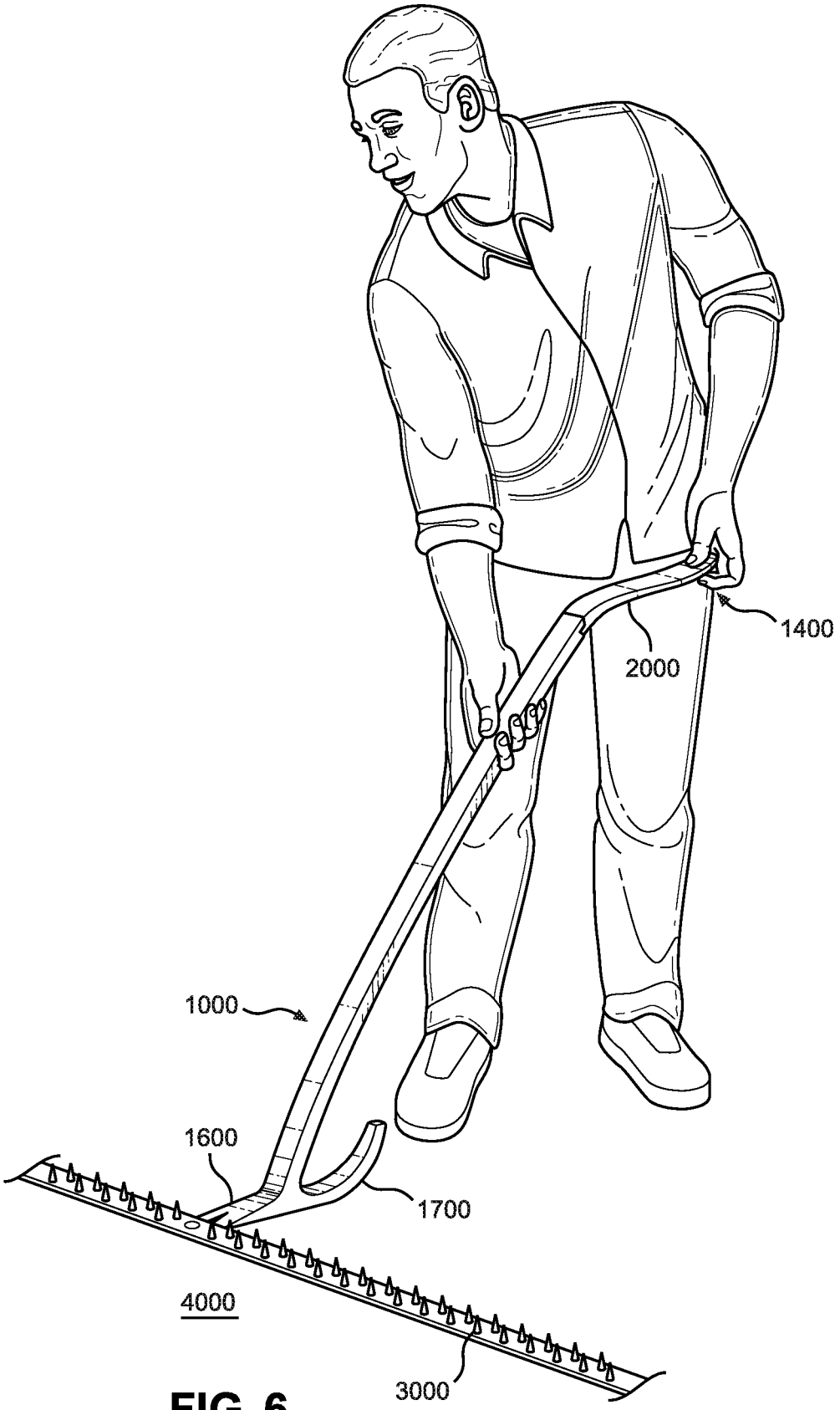
FIG. 6 shows a perspective in use view of one embodiment of the carpet tack strip removal tool removing a tack strip from a floor surface.

Referring now to FIGS. 1 and 2, there is shown a perspective and side view of one embodiment of the carpet tack strip removal tool, respectively. The carpet tack strip removal tool 1000 provides a device that allows a user to stand while removing tack strips from carpeting and other fastening mechanisms generally used on the floor, thereby preventing undue strain to the user's body. The carpet tack strip removal tool 1000 comprises a shaft 1100 having a lifting arm 1400 at a first end 1200 and a head 1500 at a second end 1300. In the shown embodiment, the shaft 1100 comprises an elongated member having a general uniform thickness. The shaft 1100 includes a length that is sufficient for the user to stand and handle the lifting arm 1400, as shown in FIG. 6.

In the shown embodiment, the head 1500 includes a pry bar arm 1600 at a first side 1510 and a fulcrum lever 1700 at a second side 1520 of the head 1500. The pry bar arm 1600 is adapted to selectively engage the tack strip and through a lifting action cause the tack strip to be removed from a floor surface. The pry bar arm 1600 and the fulcrum lever 1700 are disposed on opposing sides of the shaft 1100 and wherein the pry bar arm 1600 and the fulcrum lever 1700 are aligned along a same vertical plane with the shaft 1100. In this way, the pry bar arm 1600, the fulcrum lever 1700, and shaft 1100 are symmetrical about that vertical plane. The fulcrum lever 1700 forms a tubular member that extends away from the shaft 1100. In one embodiment, the fulcrum lever 1700 is curved towards the first end 1200. A lower side of the head 1500 may be position upright on a floor surface and remain erect in a stable position.

The lifting arm 1400 extends from the shaft 1100 and provides an area for handling by the user. The lifting arm 1400 may be integral with the shaft. In an alternative embodiment, the lifting arm 1400 is removable from the shaft. In another embodiment, the lifting arm 1400 includes a curvature that is different from the shape of the curvature of the shaft 1100. The lifting arm 1400 may include a curve that aligns generally horizontally, so as to be generally parallel with the floor surface in the upright position. In this way, the curvature and position of the lifting arm 1400 allows for pressing downward (towards the floor surface) to cause the head to rotate and cooperatively encourage the pry bar arm 1600 to raise from the floor surface and the fulcrum lever 1700 to rock across the floor surface.

The shaft 1100 is shown extending from the head 1500 at an angle, i.e. not vertical. In one embodiment, the pry bar member 1600 and the shaft 1100 form an obtuse angle therebetween and the fulcrum lever 1700 and the shaft 1100 form an acute angle therebetween.

Figure 3A:
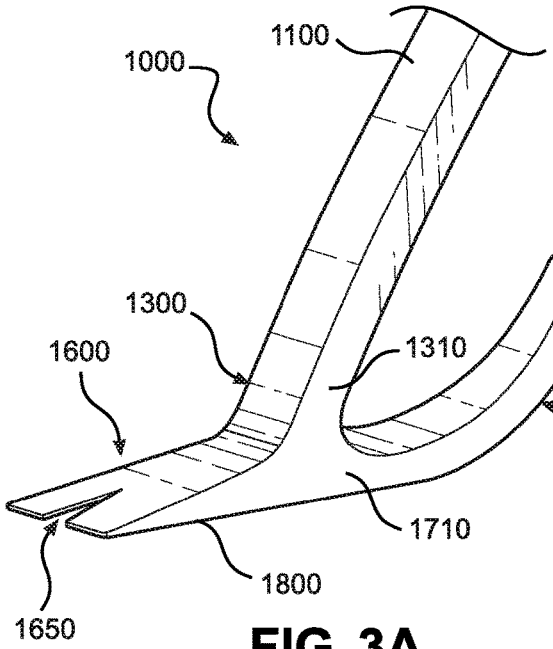
FIG. 3A shows a close-up view of the first end of the embodiment of the carpet tack strip removal tool of FIG. 1 taken along circle 3-3 in a setup position.
Figure 3B:
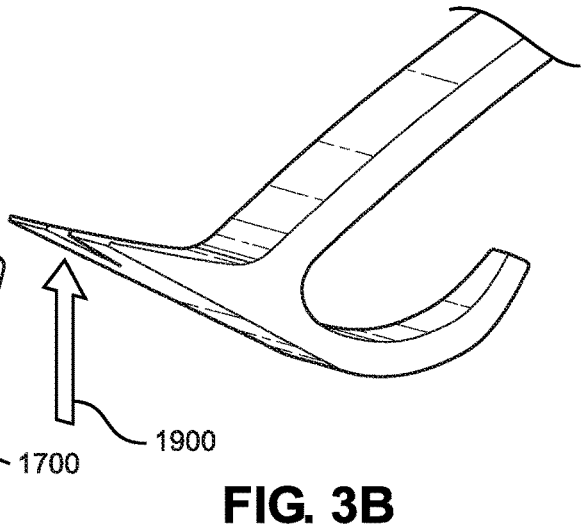
FIG. 3B shows a close-up view of the first end of the embodiment of the carpet tack strip removal tool of FIG. 1 taken along circle 3-3 in a lifting position.

Referring now to FIGS. 3A and 3B, there is shown close-up views of the first end of the embodiment of the carpet tack strip removal tool of FIG. 1 taken along circle 3-3 in a setup position and a lifting position, respectively. In the shown embodiment, the carpet tack strip removal tool 1000 is adapted to lift tack strips by a user in a standing position by transitioning between a setup position to a lifting position. In the setup position, the pry bar arm 1600 is positioned under the tack strip (not shown) to be lifted from the floor surface. In the lifting position, the lifting arm (not shown) and the fulcrum lever 1700 are operated to move towards the floor surface thereby lifting the pry bar arm 1600 and the object from the floor surface.

In the shown embodiments, as the carpet tack strip removal tool 1000 transitions from the setup position to the lifting position, a fulcrum point remains entirely on the fulcrum lever 1700. The "fulcrum point" is considered a point where a lever turns; in particular, the pivot point. By having the fulcrum point remain entirely on the fulcrum lever 1700, the shaft may remain relatively upright throughout the transition between the setup and lifting positions. Additionally, the construction of the shaft 1100 may be simpler and require less intricate construction. For example, other known crowbar type devices may utilize a shaft having a swan neck to function as the fulcrum point. However, having the fulcrum point lie on the shaft requires contact with the floor surface directly. This is disadvantageous as the fulcrum point is not stable during usage.

In the shown embodiment, a proximal end 1710 of the fulcrum lever 1700 extends from a distalmost end 1310 of the second end 1300 of the shaft 1100 and the fulcrum lever 1700 curves toward the shaft 1100. The pry bar arm 1600 and the fulcrum lever 1700 form a continuous lower side 1800. The continuous lower side 1800 provides stability to the user when the carpet tack strip removal tool 1000 transitions between the setup and lifting positions.

In one embodiment, the carpet tack strip removal tool 1000 comprises the shaft 1100, the fulcrum lever 1700, and the pry bar arm 1600 which are formed by a rigid monolithic member. In this way, the carpet tack strip removal tool 1000 allows for mechanical advantage during the application of the lifting force to the lifting arm.

In the shown embodiment, the angle position of the shaft 1100 relative to the floor surface controls the position of the fulcrum point on the fulcrum lever 1700, which in turn controls the lifting direction of the pry bar arm 1600 and maximum lifting height 1900. The angle position of the shaft 1100 relative to the floor surface is best measured from a side view, such as shown in FIG. 2. In the shown embodiment, the angle position of the shaft 1100 is between eighty and 60 degrees. However, in alternative embodiments, the angle position of the shaft 1100 may be greater or less than shown. The maximum lifting height 1900 is defined as the distance between the floor surface and the pry bar arm 1600 that would allow for lifting of the desired object.

In some embodiments, the fulcrum lever 1700 of the carpet tack strip removal tool 1000 includes a degree of curvature which causes the lifting force exerted on the lifting arm to increase progressively as the maximum lifting height 1900 increases. In other embodiments, the degree of curvature causes the lifting force exerted on the lifting arm to decrease progressively as the maximum lifting height 1900 decreases or remain constant throughout the transition. In some embodiments, the fulcrum lever 1700 of the carpet tack strip removal tool 1000 includes a length provides for additional mechanical advantage and a larger relative maximum lifting height 1900.

In some embodiments, the pry bar arm 1600 of the carpet tack strip removal tool 1000 includes a length provides for additional mechanical advantage and a larger relative maximum lifting height 1900.

In the shown embodiment, the pry bar arm 1600 comprises a V-shaped notch 1650 at a tip thereof. The V-shaped notch 1650 adapted to fit between tack strips to be lifted from the floor surface and receive a nail or other fastener that secures the tack strip to the floor surface. As shown, the V-shaped notch 1650 is facing distally and is positioned at a middle of the pry bar arm 1600. Additionally, the pry bar arm 1600 is wedge shaped such that it tapers in thickness to a distalmost end thereof, wherein the pry bar arm 1600 is adapted to be positioned under the tack strip to be lifted from the floor surface.

Figure 4:
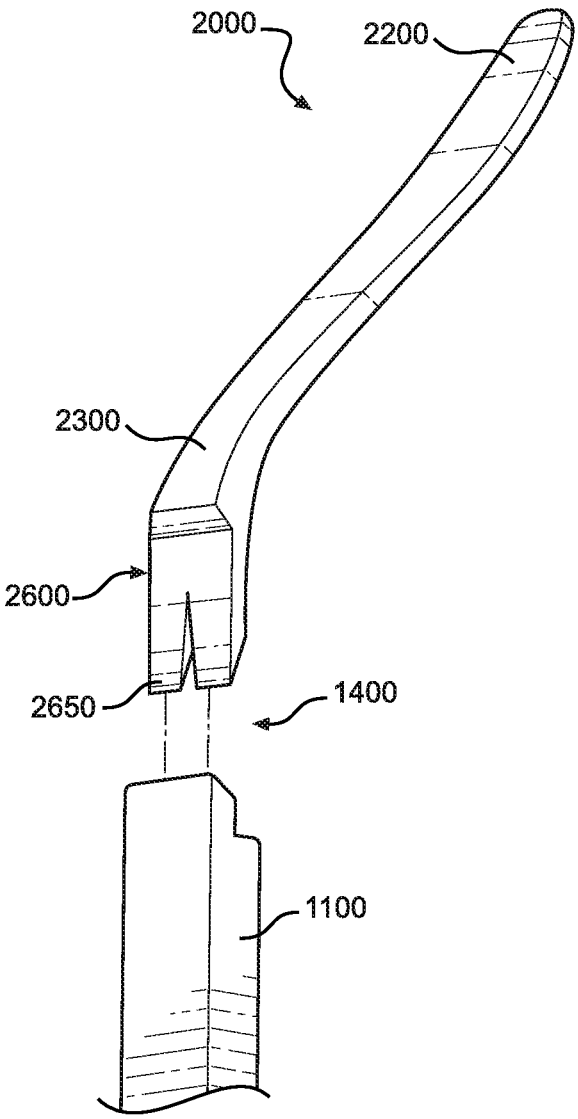
FIG. 4 shows a close-up view of the second end of one embodiment of the carpet tack strip removal tool with the secondary carpet tack strip removal tool being removed from the shaft.
Figure 5:
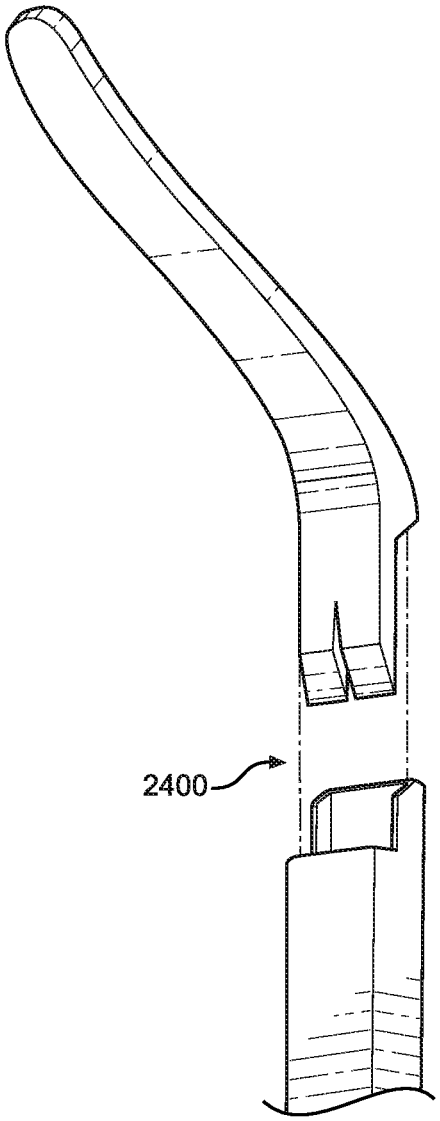
FIG. 5 shows an alternative close-up view of the second end of one embodiment of the carpet tack strip removal tool with the secondary carpet tack strip removal tool being removed from the shaft.

Referring now to FIGS. 4 and 5, there is shown a close-up view of the second end of one embodiment of the carpet tack strip removal tool with the secondary carpet tack strip removal tool being removed from the shaft and an alternative close-up view of the second end of one embodiment of the carpet tack strip removal tool with the secondary carpet tack strip removal tool being removed from the shaft, respectively. In the shown embodiment, the secondary carpet tack strip removal tool 2000 is removably from the lifting arm 1400. The secondary carpet tack strip removal tool 2000 comprises a second pry bar member 2600 that is removable from the shaft 1100. The secondary carpet tack strip removal tool 2000 further comprises a fulcrum point 2300 intermediate a handle 2200 and a second pry bar member 2600. The fulcrum point 2300 of the secondary carpet tack strip removal tool 2000 comprises a curve shape such that applying a lifting force to the handle 2200 causes the second pry bar member 2600 that is fitted between the tack strip and the floor surface to lift the tack strip.

In the shown embodiment, the lifting arm 1300 includes a recess 2400 disposed within first end 1200 of the shaft 1100 and is configured to receive the second pry bar member 2000, such that when the handle 2200 is secured to the lifting arm 1400, the second pry bar member 2600 of the secondary carpet tack strip removal tool 2000 is concealed. The recess 2400 is oriented away from the shaft 1100 and is adapted to frictionally engage the second pry bar member 2000 to semi-permanently couple. In other embodiments, the second pry bar member 2000 secures to the shaft 1100 via other fasteners, such as a latch, a threaded connection, and the like. The recess 2400, as shown, includes an asymmetrical shape shaped to receive the tapered second pry bar member 2600.

In the shown embodiment, the second pry bar member 2600 includes V-shaped notch 2650 at the tip adapted to remove tack strips from a floor surface. As shown, the V-shaped notch 2650 is facing distally and is positioned at a middle of the pry bar arm 2600. Additionally, the pry bar arm 2600 is wedge shaped such that it tapers in thickness to a distalmost end thereof, wherein the pry bar arm 2600 is adapted to be positioned under the tack strip to be lifted from the floor surface.

In the shown embodiment, the lifting arm 1400 and the handle 2200 of the secondary carpet tack strip removal tool forms a coextensive exterior when the handle 2200 is secured to the lifting arm 1400.

In one embodiment, the handle 2200 is positioned on the same side as the fulcrum lever 1700, when the handle 2200 is secured to the shaft 1100.

Referring now to FIG. 6, there is shown a perspective in use view of one embodiment of the carpet tack strip removal tool removing a tack strip from a floor surface. In operation of the shown embodiment, the carpet tack strip removal tool 1000 is shown in the setup position, wherein the user is in a standing position and gripping the lifting arm 1400 and shaft of the present device. The carpet tack strip removal tool 1000 includes a shaft having a lifting arm at a first end and a head at a second end; the head includes a pry bar arm 1600 at a first side and a fulcrum lever 1700 at a second side of the head, wherein the pry bar arm 1600 and the fulcrum lever 1700 are disposed on opposing sides of the shaft. The pry bar arm 1600 and the fulcrum lever 1700 are aligned along a same vertical plane and a proximal end of the fulcrum lever 1700 extends from a distalmost end of the second end of the shaft and the fulcrum lever 1700 curves toward the shaft. The carpet tack strip removal tool 1000 is adapted to lift the carpet tack strip 3000 by a user in a standing position by transitioning between a setup position to a lifting position. The user positions the pry bar arm 1600 between a floor surface 4000 and the carpet tack strip 3000 in the setup position. The user is standing and applying a lifting force to the lifting arm 1400 causing the carpet tack strip removal tool 1000 to the lifting position such that the fulcrum lever 1700 acts as a fulcrum point to lift the pry bar arm 1600 and the carpet tack strip 3000 from the floor surface.

In an alternative operation, the carpet tack strip removal tool 1000 further comprises a secondary carpet tack strip removal tool 2000 having a fulcrum point intermediate a handle and a second pry bar member, wherein the second pry bar member includes V-shaped notch at the tip adapted to remove tack strips from a floor surface. The lifting arm 1400 includes a recess disposed within first end and is configured to receive the second pry bar member such that when the handle is secured to the lifting arm the second pry bar member of the second pry bar member is concealed.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A carpet tack strip removal tool for removing a tack strip from a floor surface, comprising:

a shaft having a lifting arm at a first end and a head at a second end;

the head includes a pry bar arm at a first side and a fulcrum lever at a second side of the head, wherein the pry bar arm and the fulcrum lever are disposed on opposing sides of the shaft;

wherein the pry bar arm and the fulcrum lever are aligned along a same vertical plane;

a proximal end of the fulcrum lever extends from a distalmost end of the second end of the shaft and the fulcrum lever curves toward the shaft;

wherein the carpet tack strip removal tool is adapted to lift the tack strip by a user in a standing position by transitioning between a setup position to a lifting position;

wherein the setup position, the pry bar arm is positioned under the tack strip to be lifted from the floor surface;

wherein the lifting position, the lifting arm and the fulcrum lever are operated to move towards the floor surface thereby lifting the pry bar arm and the tack strip from the floor surface;

wherein the lifting arm comprises a secondary carpet tack strip removal tool having a second pry bar member that is removable from the shaft.

2. The carpet tack strip removal tool of claim 1, wherein the pry bar arm comprises a V-shaped notch at a tip thereof, wherein the V-shaped notch is adapted to receive a nail to be lifted from the floor surface.

3. The carpet tack strip removal tool of claim 1, wherein the pry bar arm is wedge shaped such that the pry bar arm tapers in thickness to a distalmost end thereof, wherein the pry bar arm is adapted to be positioned under the tack strip to be lifted from the floor surface.

4. The carpet tack strip removal tool of claim 1, wherein the pry bar arm and the shaft form an obtuse angle therebetween and the fulcrum lever and the shaft form an acute angle therebetween.

5. The carpet tack strip removal tool of claim 4, wherein the pry bar arm and the fulcrum lever form a continuous lower side.

6. The carpet tack strip removal tool of claim 5, wherein the transition from the setup position to the lifting position, a fulcrum point remains entirely on the fulcrum lever.

7. The carpet tack strip removal tool of claim 6, wherein an angle position of the shaft relative to the floor surface controls a position of the fulcrum point on the fulcrum lever, which in turn controls a lifting direction of the pry bar arm and maximum lifting height.

8. The carpet tack strip removal tool of claim 6, wherein the shaft, the fulcrum lever, and the pry bar arm are formed by a rigid monolithic member.

9. The carpet tack strip removal tool of claim 1, wherein the secondary carpet tack strip removal tool comprises a fulcrum point intermediate a handle and a second pry bar member, wherein the second pry bar member includes V-shaped notch at a tip adapted to receive a nail from a floor surface.

10. The carpet tack strip removal tool of claim 9, wherein the lifting arm includes a recess disposed within the first end and is configured to receive the second pry bar member, such that when the handle is secured to the lifting arm the second pry bar member of the second pry bar member is concealed.

11. The carpet tack strip removal tool of claim 10, wherein the recess is oriented away from the shaft.

12. The carpet tack strip removal tool of claim 11, wherein lifting arm and the handle of the secondary carpet tack strip removal tool forms a coextensive exterior when the handle is secured to the lifting arm.

13. The carpet tack strip removal tool of claim 12, wherein the fulcrum point of the secondary carpet tack strip removal tool comprises a curve shape such that applying a lifting force to the handle causes the second pry bar member that is fitted between the tack strip and the floor surface to lift the tack.

14. The carpet tack strip removal tool of claim 13, wherein the handle is positioned on the same side as the fulcrum lever.

15. A method of removing a carpet tack strip, comprising:

providing a carpet tack strip removal tool, the carpet tack strip removal tool comprising:

a shaft having a lifting arm at a first end and a head at a second end;

the head includes a pry bar arm at a first side and a fulcrum lever at a second side of the head, wherein the pry bar arm and the fulcrum lever are disposed on opposing sides of the shaft;

wherein the pry bar arm and the fulcrum lever are aligned along a same vertical plane;

a proximal end of the fulcrum lever extends from a distalmost end of the second end of the shaft and the fulcrum lever curves toward the shaft;

wherein the carpet tack strip removal tool is adapted to lift the carpet tack strip by a user in a standing position by transitioning between a setup position to a lifting position;

positioned the pry bar arm between a floor surface and the carpet tack strip in the setup position;

standing and applying a lifting force to the lifting arm causing the carpet tack strip removal tool to transition to the lifting position such that the fulcrum lever acts as a fulcrum point to lift the pry bar arm and the carpet tack strip from the floor surface;

providing a secondary carpet tack strip removal tool, comprising a fulcrum point intermediate a handle and a second pry bar member, wherein the second pry bar member includes V-shaped notch at a tip adapted to receive a nail from a floor surface:

wherein the lifting arm includes a recess disposed within the first end and is configured to receive the second pry bar member such that when the handle is secured to the lifting arm the second pry bar member of the second pry bar member is concealed.

16. A carpet tack strip removal tool for removing a tack strip from a floor surface, comprising:

a shaft having a lifting arm at a first end and a head at a second end;

the head includes a pry bar arm at a first side and a fulcrum lever at a second side of the head, wherein the pry bar arm and the fulcrum lever are disposed on opposing sides of the shaft;

wherein the pry bar arm and the fulcrum lever are aligned along a same vertical plane;

a proximal end of the fulcrum lever extends from a distalmost end of the second end of the shaft and the fulcrum lever curves toward the shaft;

wherein the carpet tack strip removal tool is adapted to lift the tack strip by a user in a standing position by transitioning between a setup position to a lifting position;

wherein the setup position, the pry bar arm is positioned under the tack strip to be lifted from the floor surface;

wherein the lifting position, the lifting arm and the fulcrum lever are operated to move towards the floor surface thereby lifting the pry bar arm and the tack strip from the floor surface;

wherein the pry bar arm and the shaft form an obtuse angle therebetween and the fulcrum lever and the shaft form an acute angle therebetween;

wherein the pry bar arm and the fulcrum lever form a continuous lower side;

wherein the transition from the setup position to the lifting position, a fulcrum point remains entirely on the fulcrum lever;

wherein the lifting arm comprises a secondary carpet tack strip removal tool having a second pry bar member that is removable from the shaft.

* * * * *